United States Patent [19]

Kuhn et al.

[11] Patent Number: 4,752,034

[45] Date of Patent: Jun. 21, 1988

[54] PORTABLE ELECTROSTATIC SPRAY GUN

[75] Inventors: Wolfgang Kuhn, Schloss Holte-Stukenbrock; Norbert Buchholz, Schlangen, both of Fed. Rep. of Germany

[73] Assignee: Kopperschmidt-Mueller GmbH & Co. KG, Bielefeld, Fed. Rep. of Germany

[21] Appl. No.: 942,164

[22] Filed: Dec. 16, 1986

[30] Foreign Application Priority Data

Dec. 23, 1985 [DE] Fed. Rep. of Germany ..... 3545885

[51] Int. Cl.[4] ..... B05B 5/00

[52] U.S. Cl. ..... 239/690; 239/707; 239/600

[58] Field of Search ..... 239/3, 690, 691, 697, 239/704–708, 600, 416.5, DIG. 14

[56] References Cited

U.S. PATENT DOCUMENTS

| | | | |
|---|---|---|---|
| 3,561,677 | 2/1971 | Norris | 239/705 |
| 3,591,080 | 7/1971 | Kock | 239/705 |
| 3,731,145 | 5/1973 | Senay | 239/708 X |
| 3,747,850 | 7/1973 | Hastings et al. | 239/707 X |
| 4,171,098 | 10/1979 | Braun | 239/708 |
| 4,290,091 | 9/1981 | Malcolm | 239/690 X |
| 4,598,871 | 7/1986 | Hartle | 239/706 |
| 4,645,151 | 2/1987 | Gimben | 239/690 X |

FOREIGN PATENT DOCUMENTS

| | | | |
|---|---|---|---|
| 2019745 | 11/1979 | United Kingdom | 239/600 |

*Primary Examiner*—Andres Kashnikow
*Assistant Examiner*—Kevin Patrick Weldon
*Attorney, Agent, or Firm*—Peter K. Kontler

[57] ABSTRACT

A portable electrostatic spray gun for liquid and/or pulverulent materials has a body with a grip and a second portion which carries a detachable barrel and has an inlet for admission of material to be sprayed. The rear side of the grip has a socket for a first unit of the high-voltage generator. A second unit of the generator is installed in a chamber provided in the second portion of the body and being accessible upon separation of the second portion from the grip. The grip contains a proximity switch which is actuatable by the trigger and can be deactivated by rotating it in the grip. The first unit of the generator has a transformer and an oscillator connected to a low-voltage input, and the second unit has a voltage multiplier connected with two high-voltage electrodes, one in the inlet and the other in an air admitting channel which is provided in the second portion of the body and includes a passage in the second unit of the generator.

23 Claims, 1 Drawing Sheet

PORTABLE ELECTROSTATIC SPRAY GUN

CROSS-REFERENCE TO RELATED CASES

Spray guns are disclosed in commonly owned copending patent application Ser. No. 830,972 of Luttermöller and in commonly owned copending patent application Ser. No. 940,623 of Kuhn.

BACKGROUND OF THE INVENTION

The invention relates to improvements in electrostatic spray guns, and more particularly to improvements in portable (hand-held) spray guns which can be used for spraying liquid and/or flowable solid materials, particularly pulverulent materials.

It is known to provide a hand-held electrostatic spray gun with a body having a grip adapted to be held by hand and supporting a trigger. A second portion of the body carries a barrel serving to receive material to be sprayed from an inlet which is provided on the body of the spray gun ahead of the trigger. It is further known to install the high-voltage generator of the spray gun in the body, particularly in the grip, and to provide the generator with at least one high-voltage electrode.

A spray gun of the above outlined character is disclosed in published European patent application No. 0 157 199. The entire high-voltage generator (the details of which are not disclosed) is installed in the grip and the generator has a plastic housing which resembles a grip. The rear side of the grip is formed with an air admitting inlet, and the grip further defines a portion of the air channel which leads to the barrel. The inlet for the material to be sprayed is provided at the front end of the body immediately behind the location where the barrel can be detached from the body. The connection between the barrel and the body comprises mating internal and external threads. The barrel is formed with a centrally located paint channel and with three additional channels which surround the paint channel and are spaced apart relative to each other at angles of 120 degrees. One of the additional channels supplies atomizer air, another additional channel supplies control air, and the third additional channel accommodates a high-voltage cable leading to a sprayer electrode.

The object of the invention which is disclosed in the published European patent application is to move the center of gravity as far back as possible in order to reduce the effort which is required to properly hold the grip for an extended interval of time. A drawback of such proposal is that the high-voltage generator must employ a number of highly miniaturized components with attendant reduction of its output. Moreover, the housing of the high-voltage generator occupies by far the major part of the grip. Thus, if the high-voltage generator must be relatively large or if the grip is to accommodate one or more additional parts of the spray gun, the dimensions of the grip must be unduly increased so that such bulky grip cannot be properly held by a hand of the operator.

OBJECTS AND SUMMARY OF THE INVENTION

An object of the invention is to provide a novel and improved hand-held electrostatic spray gun wherein the body of the spray gun can accommodate a large and powerful high-voltage generator without it being necessary to unduly increase the bulk of the grip.

Another object of the invention is to provide a spray gun wherein the location of the center of gravity is selected with a view to facilitate manipulation and holding of the spray gun by hand for long periods of time and wherein the body of the spray gun can readily accommodate a large and efficient high-voltage generator which need not necessarily employ miniaturized parts.

A further object of the invention is to provide a spray gun wherein the handle can accommodate a number of components other than the high-voltage generator without unduly increasing its weight and/or bulk.

An additional object of the invention is to provide a novel and improved high-voltage generator for use in the above outlined spray gun.

Another object of the invention is to provide a spray gun wherein the current-carrying parts are safely insulated from the hand of the operator.

A further object of the invention is to provide a novel and improved method of installing a high-voltage generator in the body of a hand-held spray gun.

Still another object of the invention is to provide a novel and improved arrangement of means for preventing operation of the high-voltage generator regardless of the position of the trigger.

The invention is embodied in a portable electrostatic spray gun for liquid but particularly for flowable solid (pulverulent) materials. The improved spray gun comprises a body having a first portion which constitutes or comprises a grip (e.g., of the type known as pistol grip) and a second portion, a barrel on the second portion, and a high-voltage generator which comprises several discrete units including a first unit in or on the grip and a second unit in the second portion of the body. The first unit is preferably mounted in the first portion of the body in the region of the rear side of the grip. The second portion of the body includes an inlet for the material to be sprayed, and the second unit can comprise voltage multipler means and high-voltage output means connected with the voltage multiplier means. The inlet is preferably disposed between the barrel and the second unit of the generator, and the first unit of the generator preferably comprises a transformer, an oscillator connected with the transformer, and a low-voltage input connected with the transformer and/or with the oscillator.

The first unit preferably further comprises a housing for the transformer and the oscillator. The rear side of the grip can be provided with a socket which removably receives the housing. The arrangement is preferably such that the exposed surface of the housing is flush with that portion of the exposed surface of the grip which surrounds the socket. The housing preferably contains or consists of a metallic material and is grounded. Such housing can have a substantially U-shaped cross-sectional outline and its width can match of approximate the width of the grip.

The front side of the grip is preferably provided with a recess and the spray gun further comprises a trigger which is movably mounted on the body and a portion of which preferably extends into the recess in all positions of the trigger. Such portion of the trigger can comprise two spaced-apart sidewalls. A switch (preferably a proximity switch) is mounted in the grip, preferably in a hole which is parallel to the front side of the grip and is disposed at a level below the trigger (it being assumed that the grip is properly held by hand so that the barrel is disposed at a level above the trigger). The lower portion of the trigger can be provided with an actuator for the switch; the actuator becomes effective in response to movement of the trigger to a predetermined position (normally by depressing the trigger by one finger of the hand which holds the grip). The switch is preferably movable in its hole so as to move into and from the range of the actuator at the lower end of the trigger. To this end, the switch can comprise or can be mounted in a slide or carriage which is rotatably mounted in the hole and is biased toward the trigger by one or more coil springs or the like. An arm (e.g., a radially extending lever) can be provided on the slide to facilitate its rotation relative to a cam which is mounted on the grip and causes the slide to move against the opposition of the spring or springs when the arm is pivoted in a selected direction. A pole of the switch is connected with the low-voltage input of the first unit of the generator.

The two portions of the body of the spray gun are preferably separable and the second portion is preferably provided with a chamber which receives the second unit of the generator and is accessible for insertion or removal of the second unit in response to separation of the second portion of the body from the grip. The means for separably connecting the barrel with the second portion of the body preferably includes a coupling which allows for proper attachment of the barrel in any one of several angular positions of the barrel relative to the body. Similar coupling means can be provided for a pipe which is separably connected to the second portion of the body and a portion of which is surrounded by the barrel, i.e., the pipe can be attached to the body in any one of several angular positions relative to the second portion of the body.

The generator comprises at least one high-voltage electrode in the second portion of the body. One electrode can be installed in the inlet for material to be sprayed, and another electrode can be installed in a channel which is defined by the second unit of the generator and serves to admit air into the barrel (e.g., into the aforementioned pipe). The one electrode is preferably mounted in the inlet at a predetermined distance from the material receiving end of the inlet, and such distance preferably equals or exceeds the length of the spark which can be generated by the one electrode. In addition, the one electrode is preferably mounted in the inlet at a given distance from the location where the barrel is separable from the second portion of the body; such given distance also equals or exceeds the length of the spark gap can be generated by the one electrode. The passage for admission of air into the pipe is preferably controlled by an adjustable flow restrictor which is mounted in the body (e.g., at the junction of the grip with the second portion of the body) a distance which at least matches the length of the spark gap which is generated by the other electrode.

The novel features which are considered as characteristic of the invention are set forth in particular in the appended claims. The improved spray gun itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
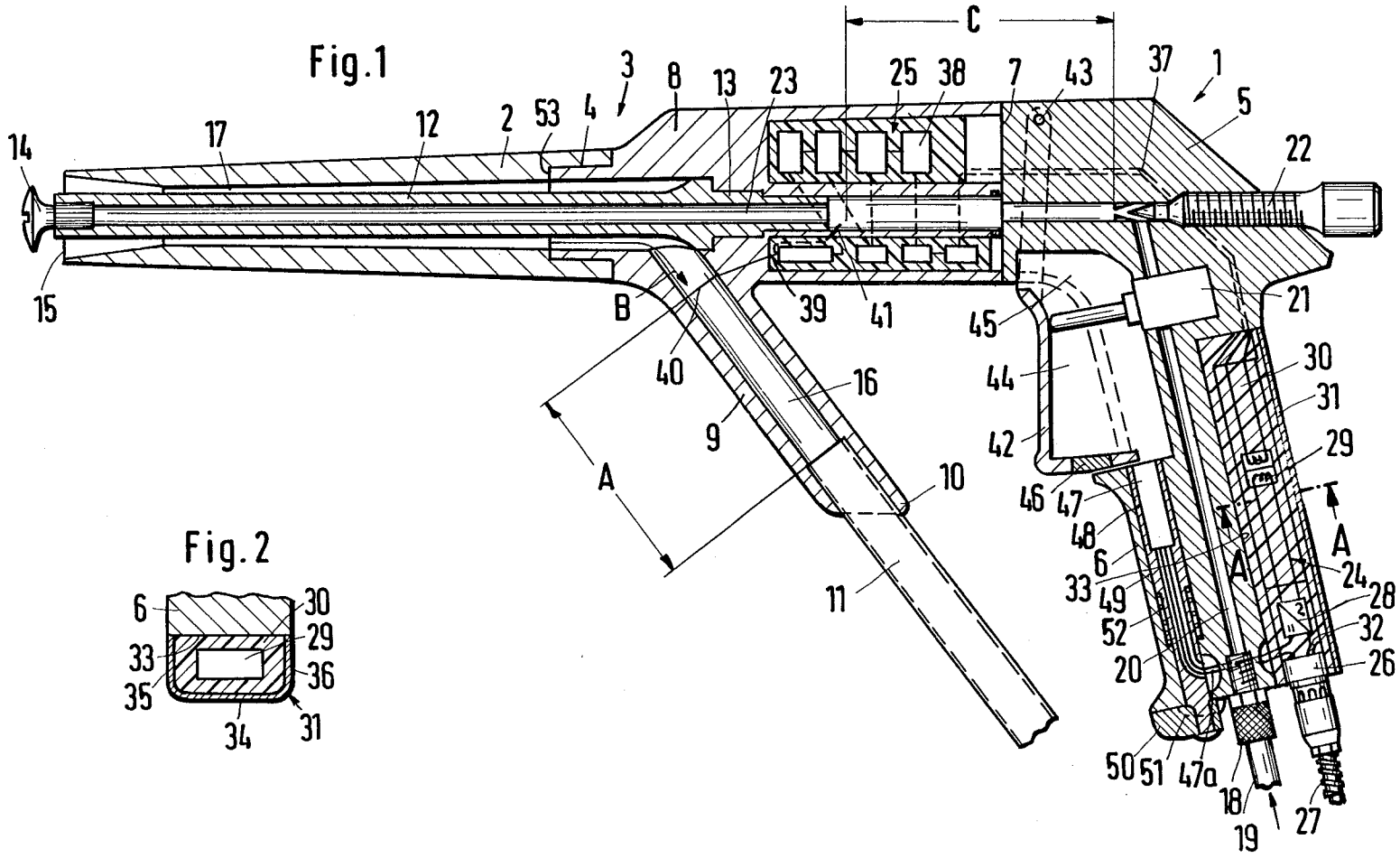
FIG. 1 is a longitudinal vertical sectional view of a portable spray gun which embodies one form of the invention.
FIG. 2 is a fragmentary sectional view of the grip and of the first unit of the high-voltage generator as seen in the direction of arrows from the line A—A of FIG. 1.

The portable (hand-held) hydrostatic spray gun which is shown in the drawing comprises a composite body 1 having a first portion 5 constituting or including a grip 6 and a second portion 8 including an inlet 9 for admission of material (e.g., powder) to be sprayed and carrying a detachable barrel 2. The location where the barrel 2 is separably connected to the portion 8 is denoted by the character 3. The coupling means for separably connecting the barrel 2 to the portion 8 of the body 1 comprises a cylindrical sleeve 4 at the rear end of the barrel and a hollow cylindrical stub 53 at the front end of the portion 8. Such configuration of the coupling means renders it possible to attach the barrel 2 to the portion 8 of the body 1 in any one of a practically infinite number of different angular positions of the barrel relative to the body 1. The portions 5 and 8 of the body 1 abut each other in a plane 7. The means for separably affixing the portion 8 to the upper part of the portion 5 can include screws, bolts or other suitable fasteners, not shown.

The lower end portion 10 of the inlet 9 constitutes the material receiving end of the inlet and is separably connected with a hose 11 or another conduit for admission of pulverulent material from a source, not shown.

The spray gun further comprises a tubular body 12 (hereinafter called pipe) which is surrounded by the barrel 2 and is separably secured to the portion 8 of the body 1 by a coupling including a nipple 13 at the rear end of the pipe 12. The nipple 13 fits into and is rotatable in a complementary bore of the portion 8 rearwardly of the hollow cylindrical stub 53. The just described coupling renders it possible to attach the pipe 12 to the portion 8 of the body 1 in any one of a number of different angular positions. This simplifies the assembly of the spray gun, e.g., after a thorough cleaning, because the person in charge need not be concerned with the exact angular position of the pipe 12 during reattachment of the pipe to the portion 8 of the body 1. The same applies for the coupling including the sleeve 4 and the stub 53, i.e., the operator need not pay attention to the angular position of the barrel 2 when the latter is reattached to the portion 8 of the body 1.

The front end portion of the pipe 12 is provided with a mushroom-shaped diffusor 14 which deflects jets of air issuing from the pipe 12 into the annular flow of pulverulent material which issues from the front end of the barrel 2. The surface 15 surrounding the discharge end of the annular path 17 for the flow of pulverulent material diverges forwardly and outwardly. The annular path 17 communicates with the central passage 16 of the inlet 9 which receives pulverulent material from the hose 11.

An air supplying hose 19 is connected with a nipple 18 at the lower end of the grip 6 and discharges a stream of air into a channel 20 which extends upwardly through the grip 6 and communicates with a channel 23 defined by the pipe 12 and leading to the diffusor 14.

The flow of air in the channel 20 is controlled by a valve 21 which, in turn, is controlled by a trigger 42 at the front side of the grip 6. The flow of air from the channel 20 into the channel 23 is further controlled by a flow restrictor 22 which is adjustably mounted in the upper rear part of the portion 5 and has an outwardly extending knob adapted to be manipulated by hand to thereby change the rate of flow of air from the hose 19 into the pipe 12.

In accordance with a feature of the invention, the high-voltage generator of the improved spray gun comprises a plurality of units or modules including a first unit 24 which is removably installed in and at the rear side of the grip 6, and a second unit 25 installed in a chamber which is adjacent the plane 7 where the portions 5 and 8 of the body 1 abut each other and is accessible upon detachment of the portion 8 from the portion 5. The second unit 25 is disposed between the location 3 (where the barrel 2 is separably secured to the portion 8) and the grip 6. The first unit 24 comprises a low-voltage input 26 which is connected to a cable 27 leading to a suitable source of electrical energy. The input 26 supplies energy to a transformer 29 and to an oscillator 28. The transformer 29 and the oscillator 28 are embedded in a mass 30 of plastic material which is confined in a metallic housing 31. The housing 31 has a substantially U-shaped cross-sectional outline and its width equals or approximates the width of the grip 6 in the region where the grip is formed with a socket 33 (provided at the rear side of the grip) for the housing 31. The reference character 32 denotes a conductor which is connected to the metallic housing 31 and to the ground. The external surface 34 of the housing 31 is preferably configurated in such a way that it is flush with that portion of the external surface of the grip 6 which surrounds the socket 33. This enables the palm of the hand of the operator to hold and manipulate the grip 6 without being interfered with by the exposed portion of the housing 31. FIG. 2 shows clearly that the outer sides of the sidewalls 35, 36 of the U-shaped housing 31 are flush with the adjacent lateral portions of the external surface of the grip 6 at the rear side of the grip. The housing 31 can be held in the socket 33 by friction and/or by using conventional fastener means, not shown. All that counts is to ensure that, if necessary, the unit 24 of the high-voltage generator can be readily detached from the grip 6 as well as that the unit 24 can be reattached to the grip in an optimum position.

The output of the first unit 24 is connected with the input of the second unit 25 by conductor means 37 disposed in the interior of the body 1. The unit 25 can comprise conventional components including a voltage multiplier 38, e.g., a cascade of capacitors and rectifiers. The high-voltage output 39 of the second unit 25 is connected with an electrode 40 in the inlet 10 (path portion 16) for pulverulent material and with an electrode 41 in that portion of the channel 23 which is defined by the unit 25 located in the chamber at the rear end of the portion 8 of the body 1. As mentioned above, the unit 25 is readily accessible and can be removed for inspection or replacement in response to detachment of the portion 8 from the portion 5 of the body 1.

The trigger 42 has upwardly extending arms which are pivotally secured (at 43) to the upper part of the portion 5 and the trigger 42 continuously extends into a recess 45 at the front side of the grip 6. The two sidewalls 44 (only one shown) of the trigger 42 extend into and are slidable along the adjacent surfaces bounding the recess 45. As shown in FIG. 1, the arrangement is such that portions of the sidewalls 44 extend into the recess 45 even when the trigger 42 is not depressed by a finger of the operator. The depth of the recess 45 is selected with a view to ensure that the trigger 42 can pivot (at 43) counterclockwise (as seen in FIG. 1) to the extent which is necessary to fully open the valve 21, i.e., to permit a stream of air to flow from the channel 20 into the channel 23 at a maximum rate. The rate at which air enters the channel 23 is determined by the setting of the adjustable flow restrictor 22. The just described mounting of the trigger 42 reduces the likelihood of jamming. By way of example, the trigger 42 can be made from a plastic material, e.g., in an injection molding or other suitable machine.

The lower portion of the trigger 42 carries a metallic actuator 46 for a switch 47 which is reciprocably mounted in an elongated cylindrical hole or bore 49 provided in and extending in parallelism with the front side of the grip 6. The illustrated switch 47 is a proximity switch which generates a signal when it is approached by the actuator 46 in response to pivoting of the trigger 42 in a counterclockwise direction (as seen in FIG. 1). Alternatively, the switch 47 can be replaced with a switch having reed contacts (the actuator 46 is then replaced with a magnet) or with any other suitable switch adapted to connect the conductor 27 to or to disconnect the conductor 27 from the first unit 24 of the highvoltage generator. One pole of the switch 47 is connected with the input 26 of the first unit 24 by conductor means 47*a*.

The switch 47 comprises or is confined in a cylindrical slide 49 which is reciprocable in the hole 48 and is also rotatable in the hole by a radially or laterally outwardly extending lever or arm 50 provided at the lower end of the front side of the grip 6. When the arm 50 is caused to pivot about the axis of the slide 49, the latter is compelled to move downwardly and away from the actuator 46 on the trigger 42 because it constitutes or comprises a follower tracking a cam 51 which is fixedly connected to or is integral with the grip 6. The arrangement is preferably such that, when the arm 50 is caused to turn through approximately 90 degrees from the neutral or inoperative position of FIG. 1, the slide 49 and the switch 47 assume their lower end positions in which the actuator 46 is ineffective in all angular positions of the trigger 42. The arm 50 can be automatically held in the operative position until the operator decides to return it to the position of FIG. 1 in which the slide 49 and the switch 47 are sufficiently close to the trigger 42 to enable the actuator 46 to influence the switch in response to depression of the trigger. One or more coil springs 52 are provided to permanently bias the slide 48 to the upper end position. The arm 50 can be pivoted by the little finger of the hand which holds the grip 6.

The distance A from the electrode 40 in the path portion 16 to the material receiving end 10 of the inlet 9 and hose 11 is greater than the length of the spark which can be generated by the electrode 40 at the selected high voltage. The same applies for the distance B of the electrode 40 from the front end face of stub 53. Moreover, the distance from the electrode 41 to the front end face of the stub 53 and the distance C from the electrode 41 to the flow restrictor 22 is greater than the longest spark which can be generated by the electrode 41 at the selected high voltage.

An important advantage of the improved spray gun is that its center of gravity is located in or close to the grip 6. The tendency of the combined weight of the barrel 2, portion 8 and pipe 12 to pivot the spray gun counterclockwise, as seen in FIG. 1, is opposed by the weight of the unit 24 (especially that of the transformer 29). Thus, the heaviest component (transformer 29) of the high-voltage generator remains in the grip 6. However, the transformer is mounted as far in the rear as possible, i.e., at the rear side of the grip 6.

Since the barrel 2 and the pipe 12 do not carry any parts which are connected to the high-voltage output 39 of the unit 25, they can be readily cleaned and/or inspected whenever necessary. Moreover, when the barrel 2 is detached from the stub 53 and the pipe 12 is detached from the portion 6 of the body 1, the relatively short portion 16 of the path for the flow of pulverulent material is readily accessible and can be cleaned from the upper end of the inlet 9, e.g., by a stream of compressed air. As mentioned above, the barrel 2 can be connected to the stub 53 in any one of a number of different angular position, and this also holds true for attachment of the pipe 12 to the portion 8 of the body 1. The barrel 2 can be detached by pulling it off the stub 53 and can be reattached by pushing it onto the stub. Analogously, the pipe 12 can be extracted from the portion 8 of the body 1 in response to the application of a pull, and the pipe can be simply pushed back into the body 8 so that its nipple 13 reenters the recess behind the stub 53.

The manipulation of the spray gun is simple because the gun is ready for operation as soon as the hose 11 is attached to the inlet 9, the air hose 19 is attached to the nipple 18 and the conductor 19 is attached to the input 26. Manipulation of the spray gun is further simplified by the fact that the hose 19 and the conductor 27 are connected to the body 1 at the lower end of the grip 6.

The illustrated spray gun can be converted for spraying of a liquid medium. The channels 20, 23 then admit the liquid medium and the annular path 17 conveys a stream of air.

If the hose 11 is connected to a specially designed source of pulverulent material which should admit material only in response to a depression of the trigger 42, the conductor 27 can be provided with a conventional sensor which responds to the flow of energy from the energy source to the unit 24 to start a pump or a blower and/or to open a valve in the path of material flow from the source to the inlet 9.

The relatively lightweight unit 25 of the high-voltage generator is placed in front of the trigger 42 because this does not unduly increase the weight of the front part of the spray gun, i.e., the hand which holds the grip 6 need not continuously resist a downward tilting of the barrel 2. The placing of unit 25 in front of the trigger 42 (i.e., its removal from the grip 6) renders it possible to use the grip as a support and as a receptacle for several other parts of the spray gun (such as the switch 47, the valve 21 and the flow restrictor 22). The unit 25 in the portion 8 of the body 1 is close to the electrodes 40 and 41, i.e., the spray gun need not employ long conductor means for connecting the high-voltage output 39 of the unit 25 with the electrodes.

The placing of the unit 24 into socket 33 at the rear side of the grip 6 exhibits the advantage that the heaviest part (transformer 29) is located as far back as possible and its weight effectively opposes the combined weight of the barrel 2, pipe 12 and portion 8 of the body 1.

The feature that the metallic housing 31 of the unit 24 is grounded (at 32) enhances the safety of the operator whose palm invariably contacts the exposed portion of the external surface 34 of the housing 31 so that the operator is also connected to the ground. The metallic housing 31 of the unit 24 is preferably a good conductor of heat to thus ensure adequate cooling of the transformer 29. The feature that the width of the housing 31 matches or approximates the width of the adjacent portion of the grip 6 contributes to streamlining of the grip and renders it possible to design the housing 31 as a part of the rear portion of the grip. The relatively wide housing 31 can confine a rather large transformer or, if the dimensions of the transformer need not be large, the depth of the housing 31 (in a direction from the rear side toward the front side of the grip 6) can be reduced accordingly.

The sidewalls 44 of the trigger 42 can be said to constitute skirts whose rear portions are permanently received in the recess 45 at the front side of the grip 6 so as to reduce the likelihood of penetration of a foreign object into the recess and resulting jamming of the trigger. The skirt including the sidewalls 44 further serves as a shield for the valve 21 which is actuated by the trigger 42. The sidewalls 44 further shield the switch 47 and the valve 21 from dust and other foreign matter.

The mounting of switch 47 in the grip 6 adjacent the trigger 42 is desirable and advantageous because the switch is close to the part which is controlled thereby, namely to the input 26 of the unit 24. Moreover, the arm 50 for moving the switch 47 in the hole 48 is within reach of a finger of the hand which holds the grip 6. This radially extending arm 50 can be replaced with other means for moving the switch 47 relative to the trigger 42 and actuator 46. However, the illustrated construction is preferred at this time because the arm 50 occupies little room, the same as the cam 51, and can be readily located and pivoted by the little finger of the hand which holds the grip 6.

The feature that the switch 47 is close to the unit 24 is further desirable and advantageous because the connection (conductor 47*a*) between the switch and the low-voltage input 26 of the unit 24 is short. The connection between one pole only of the switch 47 and the input 26 is simple and inexpensive, i.e., it can comprise a single conductor. The cable 27 adds little to the weight of the spray gun.

The placing of electrodes 40, 41 at a certain distance from the front end of the barrel 2 exhibits the advantage that the electrodes are nearer to the high-voltage output 39 of the unit 25, i.e., the high-voltage cables which connect the electrodes with the output 39 are relatively short. In addition, the barrel 2 need not carry any parts which are connected to the high-voltage output 39. This is of advantage because the barrel 2 can be readily cleaned without risking mechanical and/or other damage to the electrodes and/or to any other parts which are connected to the output 39, e.g., by the cleaning or rinsing agent which could attack the parts of the high-voltage system. Moreover, the absence of any current-carrying parts in the barrel 2 renders it possible to construct the coupling 4, 53 in such a way that the barrel 2 can be connected to the portion 8 of the body 1 in any one of a number of different angular positions. The same applies for the pipe 12 which also does not carry any parts that must be connected to the output 39. The placing of electrode 41 into that portion of the channel 23 which is defined by the unit 25 ensures that this electrode is even more reliably shielded from contaminants.

The aforementioned placing of the electrode 40 at the distance A from the material receiving end 10 of the inlet 9 and the discharge end of the hose 11, and at the distance B from the front end face of the stub 53 ensures that the operator cannot be injured even if the trigger 42 is accidentally depressed while the barrel 2 is detached from the portion 8 of the body 1 because the spark which can be generated by the electrode 40 cannot be felt by the operator. Moreover, such mounting of the electrode 40 greatly reduces the likelihood of an explosion in an atmosphere containing a certain solvent. The situation is the same in connection with the placing of the electrode 41 at a requisite distance C from the front end face of the stub 53 and from the flow restrictor 22.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An electrostatic hand spray gun for flowable liquid or pulverulent materials, comprising a body having a first portion constituting or including a grip and a second portion which is separable from said first portion in a predetermined plane, said second portion having an inlet for the material to be sprayed and a chamber adjacent said plane; a barrel; means for separably connecting said barrel to said second portion; and a high-voltage generator comprising a plurality of discrete units including a first unit in or on said grip and a second unit in the chamber of said second portion so that it is accessible upon separation of said first and second portions from each other, said inlet being located between said barrel and said second unit, said first unit including transformer means and oscillator means connected to said transformer means, said second unit comprising voltage multiplier means.

2. The spray gun of claim 1, wherein said grip has a front side and a rear side and said first unit is mounted in the grip in the region of said rear side.

3. The spray gun of claim 2, wherein said second unit further includes high-voltage output means connected with said multiplier means, said first unit further comprising low-voltage input means connected with said transformer means.

4. The spray gun of claim 2, wherein said first unit comprises a housing for said transformer means and said oscillator means, the rear side of said grip having a socket and said housing being removably received in said socket.

5. The spray gun of claim 4, wherein said grip has an exposed surface surrounding said socket and said housing has an exposed surface which is flush with the exposed surface of said grip.

6. The spray gun of claim 4, wherein said housing contains a metallic material and is grounded.

7. The spray gun of claim 4, wherein said grip has a predetermined width and said housing has a substantially U-shaped cross-sectional outline and a width approximating or matching said predetermined width.

8. The spray gun of claim 1, wherein said grip has a front side and a recess in said front side, and further comprising a trigger mounted on said body and having a portion extending into said recess.

9. The spray gun of claim 8, wherein said portion of said trigger includes two spaced-apart sidewalls.

10. The spray gun of claim 1, wherein said grip has a front side and further comprising a trigger movably mounted on said body adjacent said front side and a switch mounted in said grip and actuatable by said trigger.

11. The spray gun of claim 10, wherein said switch is a proximity switch and is disposed at a level below said trigger, said trigger having a lower portion provided with actuating means for said switch.

12. An electrostatic spray gun for flowable liquid or pulverulent materials, comprising a body having a first portion constituting or including a grip having a front side, and a second portion; a barrel on said second portion; a high-voltage generator comprising a plurality of discrete units including a first unit in or on said grip and a second unit in or on said second portion; a trigger movably mounted on said body adjacent said front side; and a switch mounted in said grip and actuatable by said trigger, said grip having an elongated hole at a level below said trigger and said switch being movably mounted in said hole, said hole being substantially parallel to the front side of said grip.

13. The spray gun of claim 12, wherein said switch includes a slide in said hole and said slide includes an arm extending laterally thereof, said slide being manually rotatable in said hole by said arm and said grip having means for moving said switch away from said trigger in response to rotation of said slide relative to said grip.

14. The spray gun of claim 13, further comprising means for biasing said slide toward said trigger.

15. The spray gun of claim 1, wherein said first unit further includes a low-voltage input connected with said transformer means and said switch has a pole connected to said input.

16. The spray gun of claim 17, wherein said connecting means includes means for releasably securing said barrel to said body in any one of a plurality of different angular positions.

17. The spray gun of claim 1, further comprising at least one high-voltage electrode in the second portion of said body.

18. The spray gun of claim 1, further comprising a pipe and coupling means for separably securing said pipe to the second portion of said body, said coupling means having means for releasably securing said pipe to the second portion of said body in any one of a plurality of different angular positions of the pipe.

19. The spray gun of claim 1, further comprising electrode means connected with said second unit and disposed in said inlet.

20. The spray gun of claim 1, wherein said second unit defines an air conveying passage and said generator further comprises an electrode in said passage.

21. The spray gun of claim 1, wherein said generator further comprises at least one high-voltage electrode arranged to generate a spark of predetermined length, said second portion being separable from said first portion at a predetermined distance from said electrode which at least matches said predetermined length.

22. The spray gun of claim 21, wherein said generator further comprises at least one high-voltage output and an electrode connected to said output, said electrode being arranged to generate a spark of predetermined length, said inlet having a material admitting end spaced apart from said electrode a distance at least matching said predetermined length.

23. The spray gun of claim 1, wherein said second portion defines a channel for admission of air into said barrel and said generator further comprises an electrode arranged to generate a spark of predetermined length and disposed in said channel, and further comprising a flow restrictor mounted in said channel and spaced apart from said electrode a distance at least matching said predetermined length.

* * * * *